US011464316B2

(12) United States Patent
Shen

(10) Patent No.: US 11,464,316 B2
(45) Date of Patent: Oct. 11, 2022

(54) LIP GLOSS BRUSH HEAD WITH STORAGE FUNCTION

(71) Applicant: APR Beauty Group Inc., Toronto (CA)

(72) Inventor: Jun Shen, New Westminster (CA)

(73) Assignee: APR Beauty Group Inc., Toronto (CA)

( * ) Notice: Subject to any disclaimer, the term of this patent is extended or adjusted under 35 U.S.C. 154(b) by 314 days.

(21) Appl. No.: 16/592,166

(22) Filed: Oct. 3, 2019

(65) Prior Publication Data

US 2021/0037950 A1 Feb. 11, 2021

(30) Foreign Application Priority Data

Aug. 5, 2019 (CN) ..... 201921276201.9

(51) Int. Cl.
*A46B 11/00* (2006.01)
*A45D 34/04* (2006.01)
*A45D 40/26* (2006.01)

(52) U.S. Cl.
CPC ..... *A45D 34/042* (2013.01); *A45D 40/262* (2013.01); *A46B 11/001* (2013.01); *A45D 34/045* (2013.01); *A45D 40/265* (2013.01); *A46B 2200/1046* (2013.01)

(58) Field of Classification Search
CPC .... A45D 34/042; A45D 34/04; A45D 34/043; A45D 34/045; A45D 34/046; A45D 40/262; A45D 40/26; A45D 40/264; A45D 40/265; A45D 40/267; A46B 11/001; A46B 2200/1046; A46B 11/00; A46B 11/0072; A46B 2200/1053
USPC ..... 401/126–129, 9, 11
See application file for complete search history.

(56) References Cited

U.S. PATENT DOCUMENTS

| | | | | |
|---|---|---|---|---|
| 5,888,005 A * | 3/1999 | Gueret | A45D 34/046 | 401/128 |
| 6,220,254 B1 * | 4/2001 | Gueret | A45D 40/267 | 132/218 |
| 7,077,592 B2 * | 7/2006 | Gueret | A45D 40/267 | 401/10 |
| 7,475,692 B2 * | 1/2009 | Hartstock | A45D 34/042 | 132/218 |
| 2008/0060669 A1 * | 3/2008 | Malvar | A45D 40/262 | 132/218 |

* cited by examiner

*Primary Examiner* — David J Walczak

(57) ABSTRACT

A lip gloss brush head includes a fixing rod, a brush head body, and a flocking sleeve comprising fluff. The fixing rod and the brush head body are integrally connected. An upper surface and a lower surface of the brush head body are both cambered surfaces. A middle portion of the upper surface of the brush head body is provided with a storage tank. The flocking sleeve is sheathed on the outer surface of the brush head body, thus covering the storage tank.

10 Claims, 2 Drawing Sheets

LIP GLOSS BRUSH HEAD WITH STORAGE FUNCTION

TECHNICAL FIELD

The present utility model relates to the technical field of lip gloss brush heads, and in particular to a lip gloss brush head with a storage function.

BACKGROUND ART

Makeup tools are an integral part of the lives of modern women and even men. A tubular makeup tool in the prior art, such as lip gloss, comprises two main parts: a lip gloss bottle and a lip gloss brush. The lip gloss brush is composed of a handle and a brush head. The brush head comprises a head, a tail rod and a flocking sleeve. One end of the tail rod is fixedly connected to the head, and the other end of the tail rod is fixedly connected to the handle. The flocking sleeve is covered with fluff, and is sheathed on the head for adsorbing a lip gloss liquid. When a user wants to use the lip gloss, she/he takes the lip gloss brush out from the lip gloss bottle. At this time, the brush head of the lip gloss brush is usually covered with the lip gloss liquid, and sometimes the amount of the lip gloss liquid on the brush head is too little, so that the user needs to dip the brush head multiple times, which is inconvenient to use and wastes the user's makeup time.

SUMMARY OF THE UTILITY MODEL

The present utility model mainly solves the technical problem existing in the prior art described above, and provides a lip gloss brush head with a storage function.

The above technical problem of the present utility model is mainly solved by the following technical solution: a lip gloss brush head with a storage function, comprising a fixing rod, a brush head body and a flocking sleeve which is covered with fluff, wherein the fixing rod and the brush head body are integrally connected, the upper surface and the lower surface of the brush head body are both cambered surfaces, the left side of the upper surface is connected to the left side of the lower surface, the middle portion of the upper surface of the brush head body is provided with a storage tank, and the flocking sleeve is sheathed on the outer surface of the brush head body.

Preferably, the brush head body has a cross section in the shape of a shuttle, the brush head body has a length of 12.8±0.1 mm, and the brush head body has a maximum width of 4.8±0.1 mm.

Preferably, the brush head body and the fixing rod are both made of a nylon material.

Preferably, the storage tank is in the shape of an ellipse, the storage tank has a length of 9±0.1 mm, the storage tank has a maximum width of 2.64±0.1 mm, and the storage tank has a maximum depth of 0.3±0.1 mm.

Preferably, the fluff has a length of 1.0±0.1 mm and the fluff has a density of 1.7 D.

The present utility model has the advantageous effects: in the present utility model, the lower surface of the brush head body adopts a cambered surface design to fit the human body lip, thereby improving the comfort in use of the product; since the storage tank is formed on the upper surface of the brush head body, the storage tank can store part of a lip gloss liquid which can thus penetrate into the fluff when in use, thereby greatly reducing the number of times for fixing the makeup, and saving the user's makeup time; and by optimizing the length and density of the fluff, the fluff gives people a soft touch when the cosmetic is applied, so that the lip will not be pricked, which improves the use experience of the product.

In the figures: 1. Fixing rod; 2. Brush head body; 3. Flocking sleeve; 4. Storage tank.

DETAILED DESCRIPTION OF EMBODIMENTS

Hereinafter, the present utility model will be further described in conjunction with the accompanying drawings and particular embodiments:

Embodiment

Figure 1:
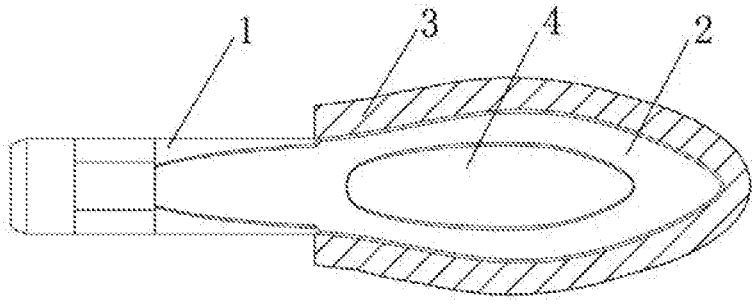
FIG. 1 is a structural schematic diagram of the present utility model.
Figure 2:
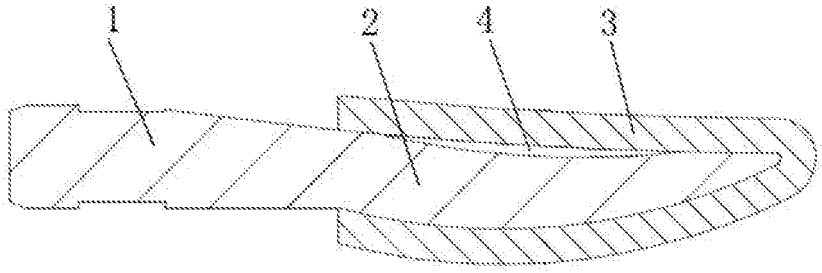
FIG. 2 is a structural cross-sectional schematic diagram of the present utility model.
Figure 3:
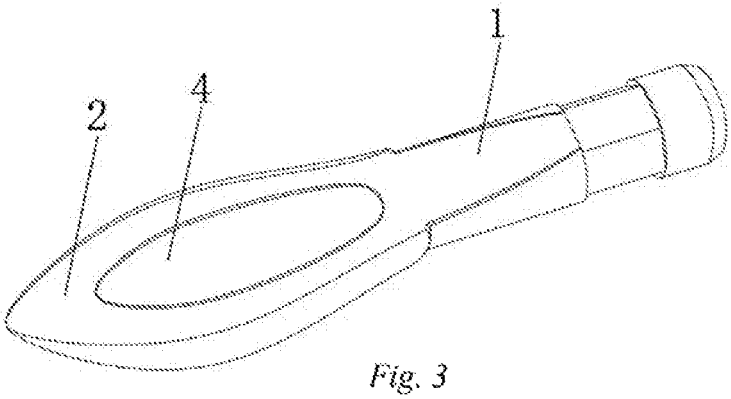
FIG. 3 is a structural schematic diagram of a brush head body of the present utility model.
Figure 4:
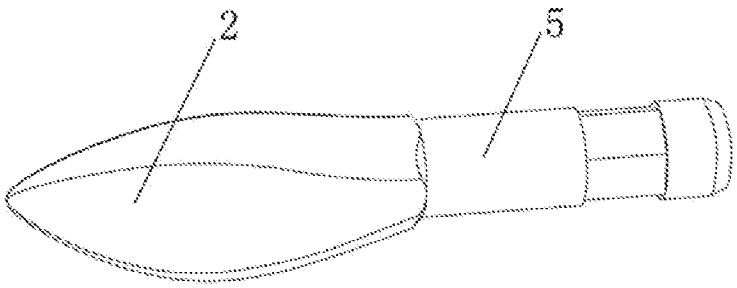
FIG. 4 is a rear-view structural schematic diagram of the brush head body of the present utility model.

A lip gloss brush head with a storage function, as shown in FIGS. 1 to 4, comprises a fixing rod 1, a brush head body 2 and a flocking sleeve 3, wherein the fixing rod 1 and the brush head body 2 are integrally connected, the other end of the fixing rod 1 is fixedly connected to a handle of a lip gloss brush. The brush head body 2 has a cross section in the shape of a shuttle, the brush head body 2 has a length of 12.8±0.1 mm, and the brush head body 2 has a maximum width of 4.8±0.1 mm. The upper surface and the lower surface of the brush head body 2 are both cambered surfaces, and the left side of the upper surface is connected to the left side of the lower surface. The lower surface of the brush head body 2 adopts a cambered surface design to fit the lip of a user. The middle portion of the upper surface of the brush head body 2 is provided with a storage tank 4. The storage tank 4 is in the shape of an ellipse, the storage tank 4 has a length of 9±0.1 mm, the storage tank 4 has a maximum width of 2.64±0.1 mm, and the storage tank 4 has a maximum depth of 0.3±0.1 mm. The flocking sleeve 3 is sheathed on the outer surface of the brush head body 2, and the inner surface of the flocking sleeve 3 abuts against the outer surface of the brush head body 2. The flocking sleeve 3 is covered with fluff of which the length is 1.0±0.1 mm and the density is 1.7 D.

The brush head body 2 and the fixing rod 1 are both made of a nylon material, and since the nylon material has a good comprehensive performance, the service life of the brush head body and the fixing rod is increased.

In the present utility model, the lower surface of the brush head body adopts a cambered surface design to fit the human body lip, thereby improving the comfort in use of the product; since the storage tank is formed on the upper surface of the brush head body, the storage tank can store part of a lip gloss liquid which can thus penetrate into the fluff when in use, thereby greatly reducing the number of times for fixing the makeup, and saving the user's makeup time; and by optimizing the length and density of the fluff, the fluff gives people a soft touch when the cosmetic is applied, so that the lip will not be pricked, which improves the use experience of the product.

The above embodiment is merely a preferred embodiment of the present utility model but not intended to limit the present utility model, and any modifications, equivalent replacements, improvements, etc. made within the spirit and principles of the present utility model should be included within the scope of protection of the present utility model.

What is claimed is:

1. A lip gloss brush head with a storage function, comprising:

a fixing rod;

a brush head body having an upper surface and a lower surface, the upper surface and the lower surface being cambered surfaces, the upper surface meeting the lower surface at a distal end of the brush head body; and a flocking sleeve which is covered with fluff;

wherein the fixing rod and the brush head body are integrally connected;

wherein the flocking sleeve is sheathed on the brush head body and an inner surface of the flocking sleeve abuts against the upper surface of the brush head body, and wherein a non-through indentation is formed in the upper surface of the brush head body, the indentation cooperating with the inner surface of the flocking sleeve to form a covered storage tank in the brush head body.

2. The lip gloss brush head with a storage function according to claim 1, characterized in that the brush head body has a cross section in the shape of a shuttle, the brush head body has a length of 12.8±0.1 mm, and the brush head body has a maximum width of 4.8±0.1 mm.

3. The lip gloss brush head with a storage function according to claim 2, characterized in that the brush head body and the fixing rod are both made of a nylon material.

4. The lip gloss brush head with a storage function according to claim 1, characterized in that the brush head body and the fixing rod are both made of a nylon material.

5. The lip gloss brush head with a storage function according to claim 1, characterized in that the storage tank is in the shape of an ellipse, the storage tank has a length of 9±0.1 mm, the storage tank has a maximum width of 2.64±0.1 mm, and the storage tank has a maximum depth of 0.3±0.1 mm.

6. The lip gloss brush head with a storage function according to claim 1, characterized in that the fluff has a length of 1.0±0.1 mm and the fluff has a density of 1.7 D.

7. The lip gloss brush head with a storage function according to claim 1, wherein the flocking sleeve is made of a material that permits a lip gloss liquid stored in the storage tank to penetrate into the fluff.

8. The lip gloss brush head with a storage function according to claim 1, wherein the indentation is formed in the upper surface spaced away from the distal end.

9. The lip gloss brush head with a storage function according to claim 8, wherein the lower surface meets the upper surface along an upper edge of the brush head body, and the indentation is formed in the upper surface spaced away from the upper edge.

10. The lip gloss brush head with a storage function according to claim 1, wherein the lower surface is a convex surface that is convexly curved along a length of the brush head body as well as convexly curved along a width direction of the brush head body.

* * * * *